US006405655B1

(12) United States Patent
Clerx et al.

(10) Patent No.: US 6,405,655 B1
(45) Date of Patent: Jun. 18, 2002

(54) AMUSEMENT DEVICE

(75) Inventors: Petrus Joseph Hubertus Clerx, Roermond; Christiaan Wilhelmus Preters, Roggel, both of (NL)

(73) Assignee: Vekoma Technology B.V., BA Vlodrop (NL)

( * ) Notice: Subject to any disclaimer, the term of this patent is extended or adjusted under 35 U.S.C. 154(b) by 0 days.

(21) Appl. No.: 09/530,522

(22) PCT Filed: Oct. 26, 1998

(86) PCT No.: PCT/NL98/00616

§ 371 (c)(1),
(2), (4) Date: Jul. 5, 2000

(87) PCT Pub. No.: WO99/22829

PCT Pub. Date: May 14, 1999

(30) Foreign Application Priority Data

Oct. 31, 1997 (NL) ..... 1007410

(51) Int. Cl.[7] ..... A63G 1/00
(52) U.S. Cl. ..... 104/63
(58) Field of Search ..... 104/53, 63, 74

(56) References Cited

U.S. PATENT DOCUMENTS 5,791,254 A * 8/1998 Mares et al. ..... 104/53

FOREIGN PATENT DOCUMENTS

| | | |
|---|---|---|
| WO | WO 96/22821 | 8/1996 |
| WO | WO 97/02878 | 1/1997 |

* cited by examiner

*Primary Examiner*—S. Joseph Morano
*Assistant Examiner*—Robert J. McCarry, Jr.

(57) ABSTRACT

An amusement device comprising a guide construction forming a track, along which a vehicle, in which at least one person can be seated, is movable in a direction of transport. A holder of the vehicle, which accommodates said person, can be tilted about a tilting axis from a first position, in which the person present in the vehicle includes an angle with the track, to a second position, in which the person who is present in the vehicle in use extends substantially parallel to the track, and vice versa. The holder is positioned above the track in said first position, whereby the tilting axis is located on a side remote from said person's head.

7 Claims, 4 Drawing Sheets

AMUSEMENT DEVICE

The invention relates to an amusement device comprising a guide construction forming a track, along which a vehicle, in which at least one person can be seated, is movable in a direction of transport, wherein a holder of the vehicle, which accommodates said person, can be tilted about a tilting axis from a first position, in which the person present in the vehicle includes an angle with the track, to a second position, in which the person who is present in the vehicle in use extends substantially parallel to the track, and vice versa.

With a similar amusement device, which is known from International patent application WO 97/02878 of the applicant, a person is seated in a substantially vertical position in a holder which is connected to the track in such a manner as to be capable of tilting movement about a tilting axis near the person's head. After the person has seated himself in the holder, the holder is tilted with respect to the track, in such a manner that the person will hang under the track with his back turned to and parallel to said track. Then the person is transported over said track in the direction of transport, as a result of which the person hanging under the track experiences a sensation of flying, as it were.

Although this manner of positioning a person under a track is satisfactory per se, the known amusement device has a few drawbacks.

With some amusement devices it is considered a drawback that users have the track present above the holders in view at a boarding and unboarding station, because said track affects the appearance of the amusement device.

Another drawback occurs at so-called emergency sections. Such an emergency section on the track is used for bringing the vehicle to a standstill in case of an emergency. If it must be possible for the person to get off the holder in the emergency section, which is preferably horizontal, an unboarding facility must be provided under the track and the holders suspended therefrom in the emergency section. This necessary unboarding facility makes the amusement device unnecessarily complicated and affects the appearance of the amusement device.

The object of the invention is to provide an amusement device, wherein a person can get on and off a holder in a simple manner, whilst said person is subsequently moved along the track in a position substantially parallel to the track.

This objective is accomplished with the amusement device according to the invention in that the holder is positioned above the track in said first position, whereby the tilting axis is located on a side remote from the person's head.

As a result of this, the track is present under the holder, and consequently under the person who is present in the holder, during boarding and unboarding. In comparison with the amusement device according to WO 97/02878, the person is tilted about his feet as it were rather than about his head. In this way, the track can be simply hidden from sight during boarding and unboarding. Furthermore, in an emergency section, wherein the holder is present on top of the track, the person can simply be moved to a vertical position by being tilted about the tilting axis and subsequently get out of the holder and leave the amusement device via an unboarding facility which is provided in or parallel to the track.

One embodiment of the amusement device according to the invention is characterized in that the holder can be moved from said first position, in which the holder is positioned above the track and in which a person present in the holder occupies a substantially vertical position, to said second position, in which the holder is positioned under the track and in which said person occupies a position with his back parallel to the track, and vice versa.

In the first position, getting on and off the holder is easy. In the second position, the person hangs under the track and experiences a sensation of flying.

Another embodiment of the amusement device according to the invention is characterized in that the holder can be moved from the first position to the second, and vice versa, via an intermediate position, wherein the holder is positioned above the track and the person occupies a position with his back parallel to the track.

In this manner, a person can be moved from a substantially vertical position in said first position of the holder, via a position substantially on his back in said intermediate position of the holder, to a position substantially on his stomach in said second position of the holder.

It is noted that from WO 96/22821 an amusement device is known wherein the person directly takes up a position in which he lies on his stomach, hanging under the track, at the boarding and unboarding station. Such a manner of boarding and unboarding is time-consuming, it is found to be embarrassing by skirt wearers, among others, it is unsuitable for elderly persons and for disabled persons, and it has the same drawbacks as regards the emergency sections as the amusement device which is known from WO 97/02878.

The invention will be explained in more detail hereafter with reference to the drawing, wherein:

FIG. 1 a side view of a part of an amusement device according to the invention, at a boarding station;

Corresponding parts are indicated by the same numerals in the FIGS.

Figure 1:
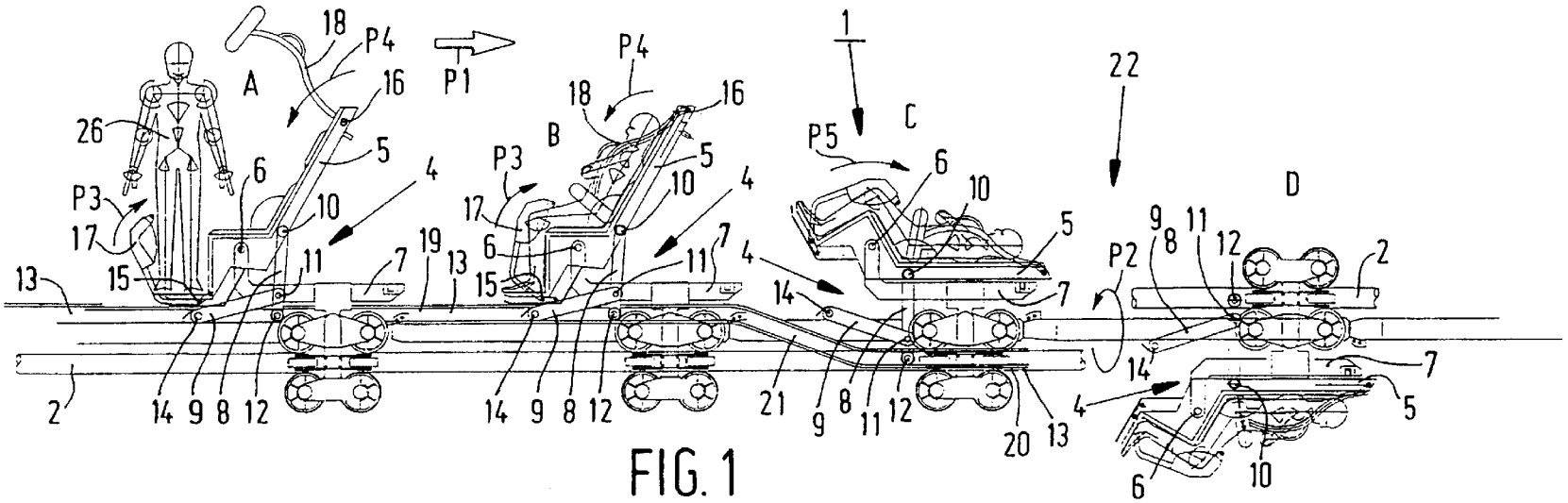
Figure 2:
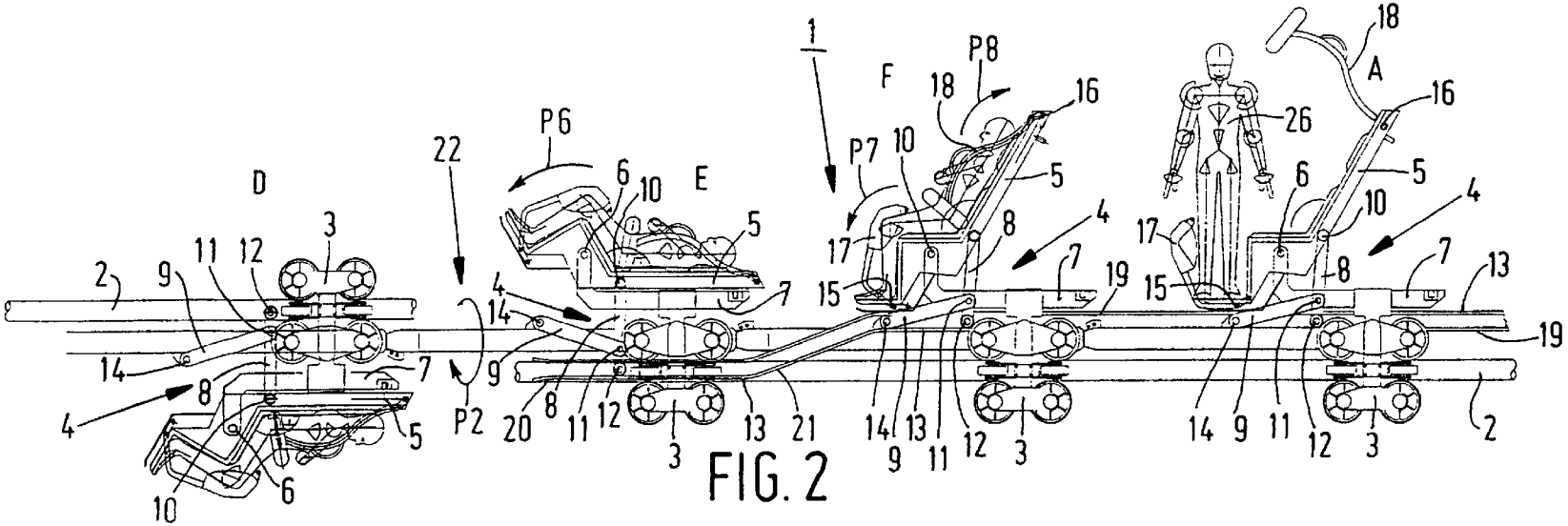
FIG. 2 shows another part of the amusement device of FIG. 1, at an unboarding station.

FIGS. 1 and 2 show an amusement device which comprises an elongated guide construction 2, which is known per se. The guide construction inter alia comprises a number of substantially parallel tubes, over which a number of coupled-together vehicles 4 comprising wheel sets 3 can move. Such wheel sets 3 are known per se, and they will not be explained in more detail, therefore. In addition to comprising at least one wheel set 3, each vehicle comprises at least one seat 5 forming a holder, which is connected to a frame 7 of vehicle 4 in such a manner that it can tilt about a tilting axis 6. Vehicle 4 furthermore comprises two pivoting arms 8, 9, wherein pivoting arm 8 is pivotally connected to seat 5 by means of a pivot pin 10 and, near the centre, to second pivoting arm 9 by means of a pivot pin 11, and wherein pivoting arm 8 is provided with a guide element 12 near an end remote from pivot pin 10, which guide element is guided in a guide track 13 of amusement device 1. Second pivoting arm 9 is pivotally connected to vehicle 4 by means of a pivot pin 14 at an end remote from pivot pin 11. Seat 5 is furthermore provided with safety bars 17, 18, which are pivoted about pivot pins 15, 16. Said safety bars form part of a separate patent application of the applicant, and consequently they will not be explained in more detail herein.

Guide track 13 of the amusement device comprises a first portion 19, which extends parallel to track 2, just below frame 7 of vehicle 4, a second portion 20, which extends parallel to track 2 and which is located on a side of the track facing away from the seat, and a sloping portion 21, which connects first portion 19 to second portion 20.

FIGS. 1 and 2 each show four successive positions (A–F) of one and the same vehicle present in a part of the amusement device according to the invention.

Figure 5:
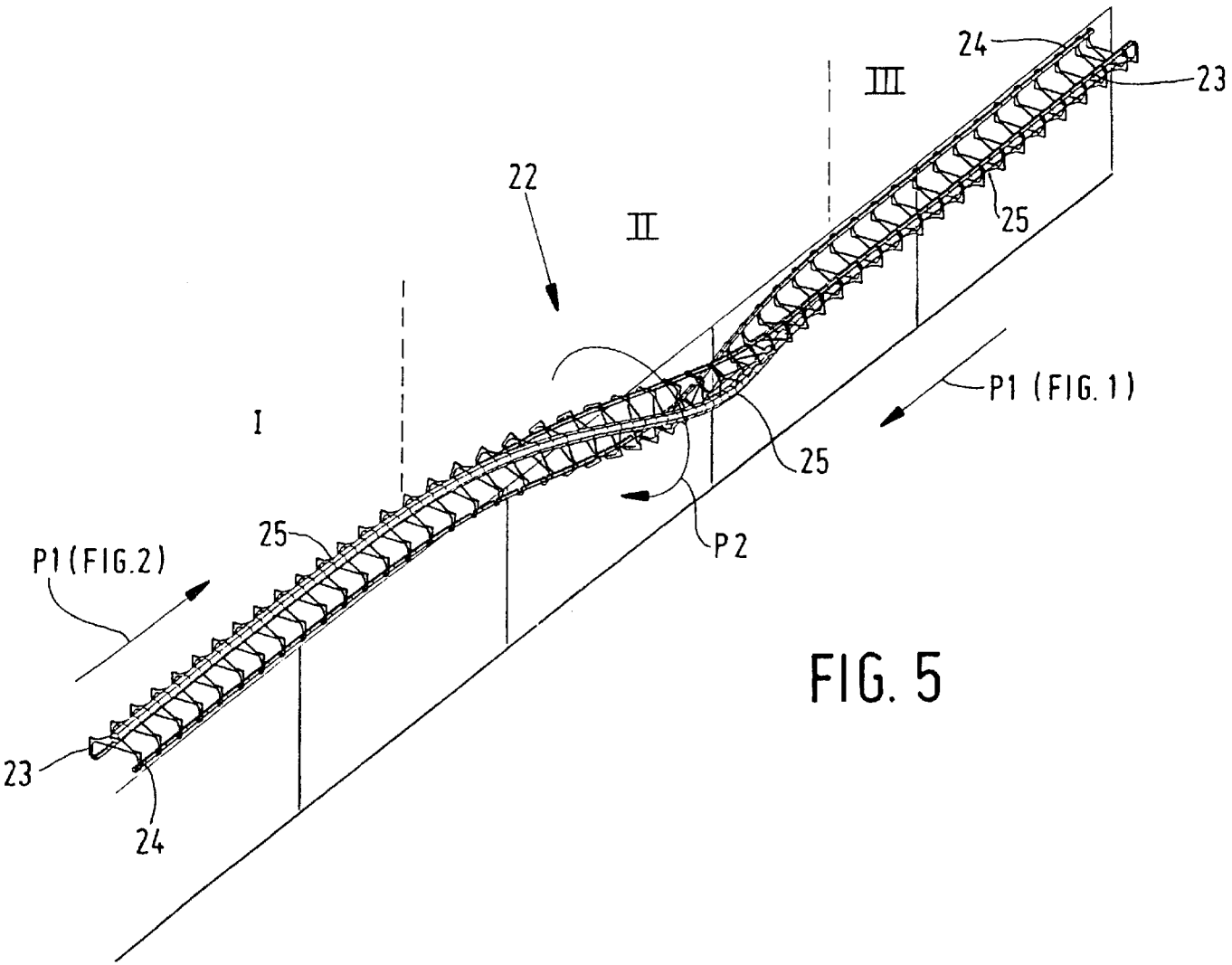
FIG. 5 shows a portion of the track of the amusement device shown in FIGS. 1–4, at a boarding or unboarding station.

Between the third and the fourth position (C, D) of the vehicle as shown in FIG. 1 and the first and the second position (D, E) of the vehicle as shown in FIG. 2, the amusement device of FIGS. 1 and 2 comprises a track portion having a corkscrew-like shape, as is for example shown in FIG. 5.

FIG. 5 shows a track portion 22 which comprises two parallel tubes 23, 24, over which wheel sets 3 of vehicles 4 can be moved. The tubes 23, 24 are interconnected by means of a supporting structure 25. The corkscrew-like track portion 22 comprises three sections I, II, III, wherein tubes 23 are positioned under supporting structure 25 in first track portion I, wherein said tubes and supporting structure 25 are twisted in a direction indicated by arrow P2, as it were, in section II, in such a manner that the tubes 23, 24 are positioned above supporting structure 25 in section III. A vehicle guided by tubes 23, 24 will likewise undergo the movement indicated by arrow P2 when being moved over track portion 22, and be moved from a suspended position under the track to a position on top of said track upon movement from section I to section III, and it will undergo a movement from a position on top of the track to a suspended position under the track upon moving from section III to section I.

The operation of the amusement device 1 will now be briefly explained. The various positions of vehicle 4 will be indicated by letters A–F. In position A of vehicle 4, a person 26 boards amusement device 1 and seats himself in seat 5. Then the safety bars 17, 18, or pivot pins 15, 16, are pivoted in the direction indicated by arrows P3, P4, thus securing person 26 in seat 5 (position B).

After person 26 has been secured in seat 5, vehicle 4 is transported in the direction indicated by arrow P1, whereby guide roller 12, which is disposed in the first portion 19 of guide track 13, enters sloping portion 21 of guide track 13, as a result of which seat 5 undergoes a tilting movement about tilting axis 6 in a direction indicated by arrow P5, and vehicle 4 takes up position C. Seat 5 is locked with respect to frame 7 in said position C. Guide track 13 terminates shortly after vehicle 4 has taken up position C. Vehicle 4 is transported further in the direction indicated by arrow P1, whereby vehicle 4 is led over corkscrew-like track portion 22. Vehicle 4 is successively moved over section III, section II and section I thereby, whereby vehicle 4 undergoes a rotation as indicated by arrow P2 about a pivot axis which extends parallel to the direction of transport P1. Vehicle 4 will occupy position D after having passed corkscrew-like portion 22.

Then the vehicle is transported over track 2, whereby track 2 may undergo various curvatures which are known per se. Person 26 is hangs under the track thereby, and lies on his stomach, as it were.

FIG. 2 shows the situation which occurs as soon as vehicle 4 approaches an unboarding station or an emergency section. Vehicle 4 moves from position 4 to a corkscrew-like track portion 22, wherein vehicle 4 is moved from section I, via section II, to section III, as a result of which vehicle 4 is rotated in the direction indicated by arrow P2, assuming position E. As a result of this, said person is positioned on his/her back, as it were. When vehicle 4 is moved further in the direction indicated by arrow P1, guide roller 12 moves into second portion 20 of guide track 13. As soon as the guide roller 12 moves into the sloping portion 21 of guide track 13, seat 5 undergoes a tilting movement about tilting axis 6 in a direction indicated by arrow P6, causing vehicle 4 to assume position F. Then safety bars 17, 18, or pivot pins 15, 16, are pivoted in directions indicated by arrows P7, P8. As a result of this, vehicle 4 will take up position A again, in which position person 26 can leave seat 5 and amusement device 1 in a simple manner.

Figure 3:
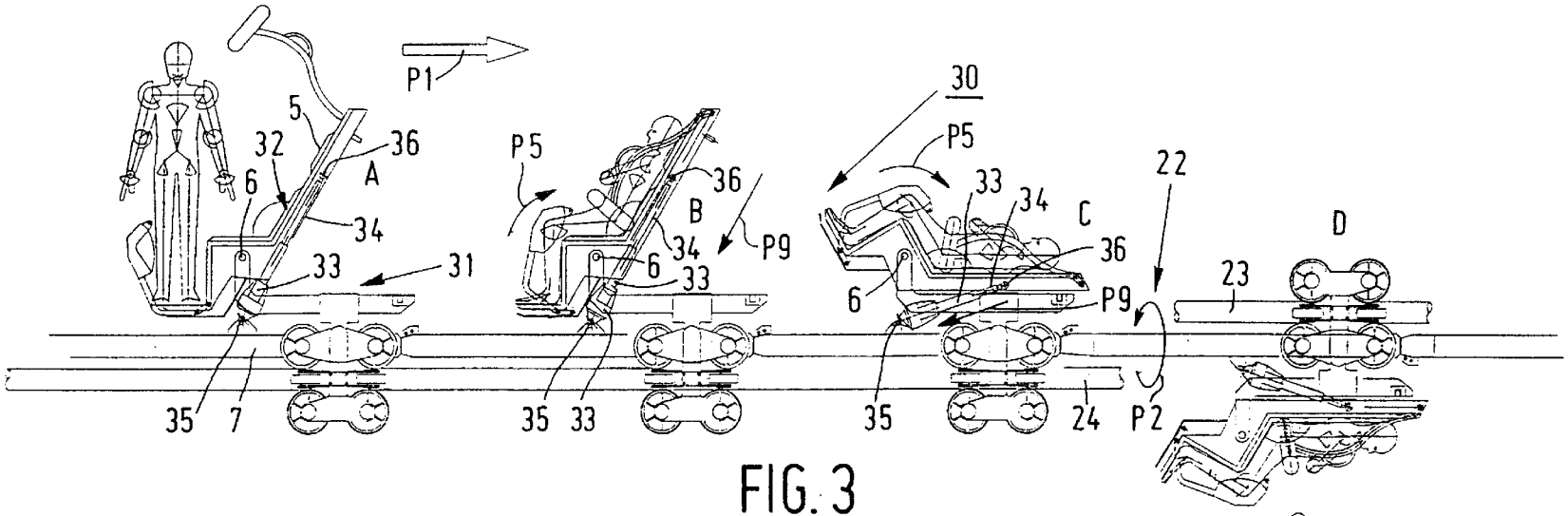
FIG. 3 is a side view of a second embodiment of an amusement device according to the invention, at a boarding station.
Figure 4:
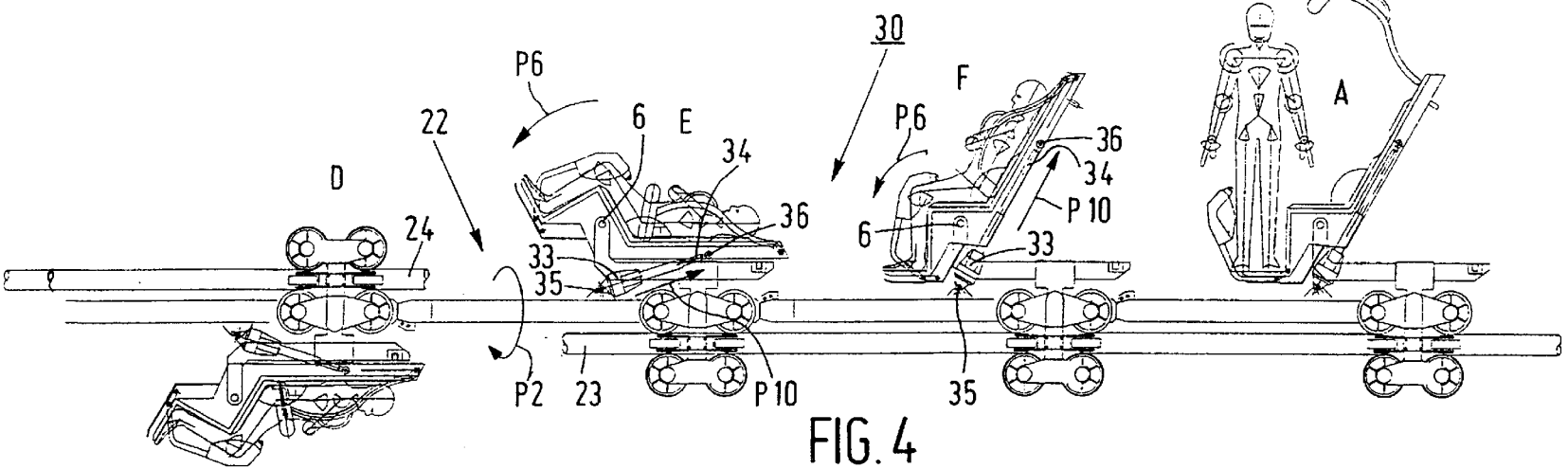
FIG. 4 shows another part of the amusement device of FIG. 3, at an unboarding station.

FIGS. 3 and 4 show a second embodiment of an amusement device 30 according to the invention, which largely corresponds with the amusement device shown in FIGS. 1 and 2, wherein the pivoting of seat 5 relative to frame 7 is carried out in a different manner, however. Each vehicle 31 of amusement device 30 is provided with linear drive 32, which comprises a cylinder 33 and a piston 34 which is capable of translating movement within said cylinder. Cylinder 33 is pivotally connected to frame 7 of vehicle 31 with an end remote from piston 34. Piston 34 is pivotally connected to seat 5, by means of a pivot pin 36, with an end remote from cylinder 33. Piston 34 can be moved into or out of cylinder 33 by pneumatic or hydraulic means, in directions indicated by arrows P9 and P1O respectively. It is also possible to use lead screw drive instead of a piston which is movable within a cylinder.

The operation of amusement device 30 largely corresponds with that of amusement device 1 shown in FIGS. 1 and 2, so that only the operation of cylinder-piston combination 33, 34 will be explained. In order to pivot seat 5 in the direction indicated by arrow P5, piston 34 is moved in cylinder 34 in the direction indicated by arrow P9, whereby the distance between pivot pin 35, 36 is reduced, and consequently seat 5 is pivoted in the direction indicated by arrow P5 from position B to position C. Upon pivoting of seat 5 from position E with respect to frame 7, in the direction indicated by arrow P6, piston 34 is moved out of cylinder 33 in the direction indicated by arrow P10, whereby the distance between pivot pins 35, 36 is enlarged, and consequently seat 5 is pivoted about pivot pin 6 in the direction indicated by arrow P6, whereby it will move from position E to position F.

The control of cylinder-piston combination 33, 34 can take place in various ways, for example by means of a control unit present on vehicle 4, by means of sliding contacts or sensors or the like, which are provided along the track.

Figures 6A, 6B:
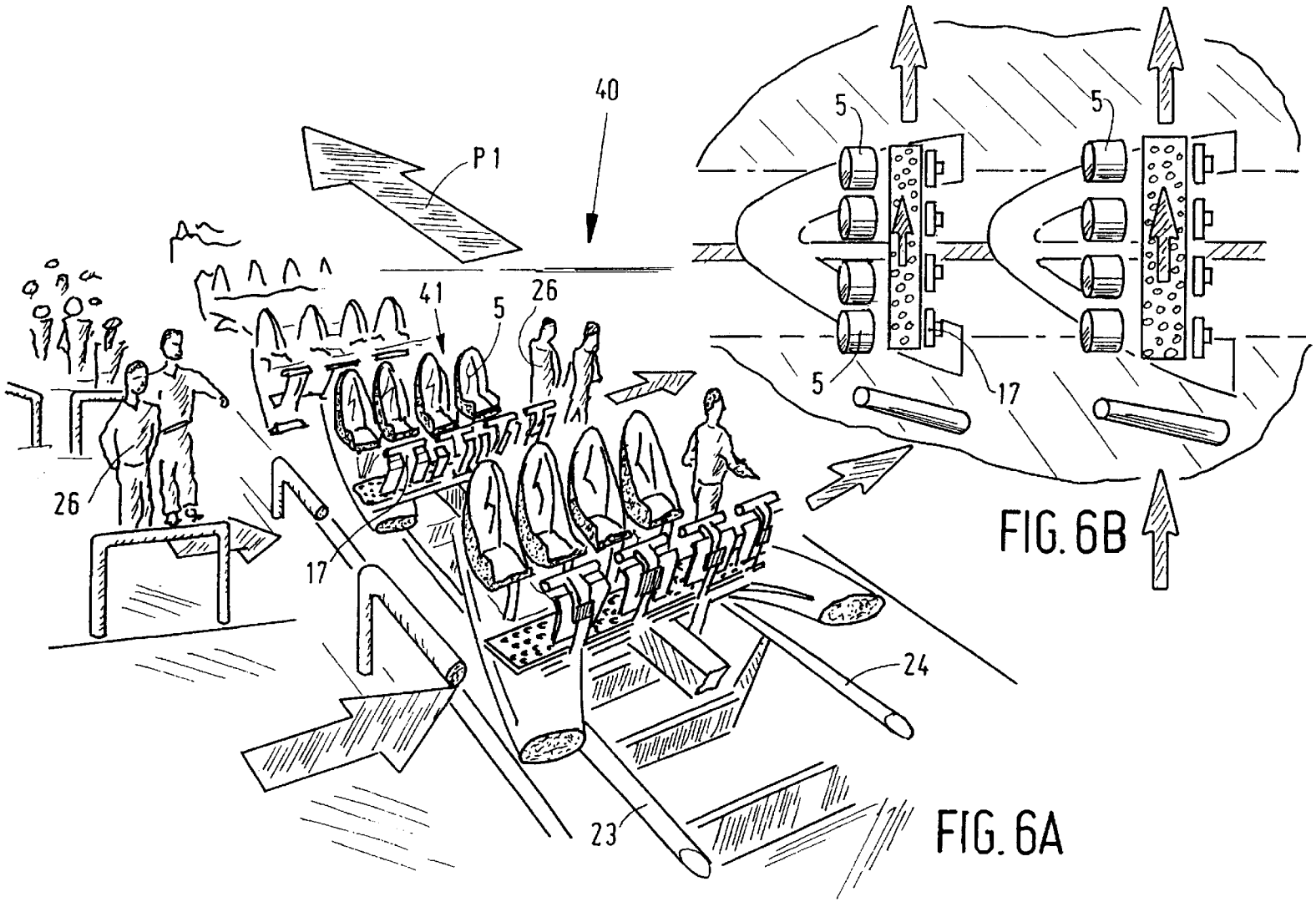
FIG. 6A is a perspective view of a boarding and unboarding station of an amusement device according to the invention.
FIG. 6B is a plan view of the amusement device which is shown in FIG. 6A.

FIGS. 6A and 6B are a perspective view and a plan view respectively of an amusement device 40 according to the invention, which is provided with a vehicle 41 which comprises a number of rows of seats 5, which rows are arranged one behind the other. As is clearly shown in the figures, the persons seat themselves in seats 5 with their backs towards the direction of transport. After persons 26 have been secured in seats 5, vehicle 41 is twisted together with track 41, as shown in FIGS. 1–3 and in FIG. 5, after which the persons are moved through amusement device 40 in a position in which they hang under the track.

Instead of twisting track 2 substantially through 180°, it is also possible to have only vehicle 4 or only seat 5 undergo a rotation in the direction indicated by arrow P2.

Furthermore it is possible, of course, for tubes 23, 24 of section I and section III respectively not to lie in the same plane, but to include an angle with each other, so that the positioning of vehicle 4 under the track takes place at the location of a transition from a horizontal to an upwardly sloping section of the track, for example.

It is also possible to have the corkscrew-like movement take place in a track portion which is already suitable for that purpose, for example a horizontal bend where the track is partially twisted already.

What is claimed is:

1. An amusement device comprising a guide construction forming a track, along which a vehicle, in which at least one person can be seated, is movable in a direction of transport, wherein a holder of the vehicle, which-accommodates said person, can be tilted about a tilting axis from a first position, in which a body longitudinal axis extending parallel to the back of the person present in the vehicle includes an angle with the track, to a second position, in which the body longitudinal axis of the person who is present in the vehicle in use extends substantially parallel to the track, and vice versa, characterized in that the holder is positioned above the track in said first position, whereby the person is positioned with his face turned away from the direction of transport in said first position and the tilting axis is located on a side of said person remote from said person's head.

2. An amusement device according to claim 1, characterized in that the holder can be moved from said first position, in which the holder is positioned above the track and in which a person present in the holder occupies a substantially vertical position, to said second position, in which the holder is positioned under the track and in which said person occupies a position with his back parallel to the track, and vice versa.

3. An amusement device according to claim 1, wherein the holder can be moved from the first position to the second, and vice versa, via an intermediate position, wherein the holder is positioned above the track and the person occupies a position with his back parallel to the track.

4. An amusement device according to claim 1, characterized in that the amusement device is provided with a boarding station and an unboarding station, wherein the holder can be moved from said second position to said first position before said unboarding station, and wherein the holder can be moved from said first to said second position in said boarding station.

5. An amusement device according to claim 1, characterized in that the holder can pivot through 180° about a pivot extending parallel to the direction of transport.

6. An amusement device according to claim 1, characterized in that the track is twisted 180° between said first and said second position of the holder, about an axis which parallel to the direction of transport.

7. An amusement device according to claim 1, characterized in that said track is provided with means for tilting the holder about said tilting axis with respect to the track.

* * * * *